US007116921B2

(12) United States Patent
Park

(10) Patent No.: US 7,116,921 B2
(45) Date of Patent: Oct. 3, 2006

(54) METHOD AND APPARATUS TO CORRECT POWER SOURCE VOLTAGE VARIATION IN AN IMAGE FORMING SYSTEM

(75) Inventor: Jong-hwa Park, Gumi-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 79 days.

(21) Appl. No.: 10/902,856

(22) Filed: Aug. 2, 2004

(65) Prior Publication Data

US 2005/0031362 A1 Feb. 10, 2005

(30) Foreign Application Priority Data

Aug. 4, 2003 (KR) ..... 10-2003-0053908

(51) Int. Cl.
*G03G 15/00* (2006.01)

(52) U.S. Cl. ..... 399/49; 399/44; 399/88

(58) Field of Classification Search ..... 399/49, 399/53, 44, 56, 60, 72, 88
See application file for complete search history.

(56) References Cited

U.S. PATENT DOCUMENTS

| | | | | |
|---|---|---|---|---|
| 5,107,301 | A | 4/1992 | Yamauchi | |
| 5,781,000 | A * | 7/1998 | Saeki et al. | 323/234 |
| 5,822,651 | A * | 10/1998 | Yim et al. | 399/66 |
| 6,115,561 | A * | 9/2000 | Fukushima | 399/49 |
| 6,262,567 | B1 * | 7/2001 | Bartlett | 323/303 |

FOREIGN PATENT DOCUMENTS

| | | |
|---|---|---|
| JP | 03-215882 | 9/1991 |
| JP | 2000-131900 | 5/2000 |
| JP | 2002-169351 | 6/2002 |
| JP | 2002-287441 | 10/2002 |
| KR | 1998-3929 | 3/1998 |
| KR | 2003-13666 A | 2/2003 |

OTHER PUBLICATIONS

Korean Official Action issued on Jul. 28, 2005, for Korean Patent Application No. 10-2003-53908 (listing 3 references).

* cited by examiner

*Primary Examiner*—Hoang Ngo
(74) *Attorney, Agent, or Firm*—Stanzione & Kim, LLP

(57) ABSTRACT

A method and apparatus to correct power source voltage variation in an image forming system. The apparatus to correct power source voltage variation includes: an image density sensing unit which senses an image density; a first variation correction unit which calculates a variation between a first power source voltage of the image density sensing unit and a first reference value, and performs correction by applying a correction amount, based on the calculated variation, to an image density sensed in the image density sensing unit; an environment detection value measuring unit which measures a roll resistance value for environment recognition; and a second variation correction unit which calculates a variation between a second power source voltage of the environment detection value measuring unit and a second reference value, and performs correction by applying a correction amount, based on the calculated variation, to a roll resistance value measured in the environment detection value measuring unit. Accordingly, when a predetermined analog value is measured to control an image density or a high voltage output, the power source voltage variation due to change in a power line or system variation is corrected such that an image density can be controlled more precisely.

16 Claims, 5 Drawing Sheets

METHOD AND APPARATUS TO CORRECT POWER SOURCE VOLTAGE VARIATION IN AN IMAGE FORMING SYSTEM

CROSS-REFERENCE TO RELATED APPLICATIONS

This application claims the priority of Korean Patent Application No. 2003-53908, filed on Aug. 4, 2003, in the Korean Intellectual Property Office, the disclosure of which is incorporated herein in its entirety by reference.

BACKGROUND OF THE INVENTION

1. Field of the Invention

The present general inventive concept relates to an image forming system, and more particularly, to a method and apparatus by which when a predetermined analog value is measured to control an image density or a high voltage output, a power source voltage variation due to change in a power line or a system variation is corrected such that the image density or the high voltage output can be precisely controlled.

2. Description of the Related Art

In an electrophotographic image forming system, when light corresponding to image information is scanned by an exposure unit on a photosensitive medium charged with a predetermined electric potential, an electrostatic latent image is formed on the photosensitive medium. A developer provides toner to the electrostatic latent image to form a toner image. Generally, in case of a color electrophotographic method, four developers containing cyan (C) toner, magenta (M) toner, yellow (Y) toner, and black (B) toner, are required. A formed toner image is transferred from the photosensitive medium to a paper directly or through an intermediate transfer medium. If the transferred toner image is passing through a fixer, the toner image is fixed on the paper by heat and pressure. Through this process, a monochrome image or a color image is printed on a paper.

Among methods for forming a color image, there are a single pass method and a multi pass method. In either case, the developing unit generally requires four developers as described above. Since the printing speed for a monochrome image is the same as that for a color image in the single pass method, the method has an advantage of high speed printing capability. In the multi pass method, printing a color image takes four times longer than printing a monochrome image in a simple calculation, but the multi pass method has an advantage that the structure of an apparatus based on this method is simpler than that based on the single pass method.

Among the kinds of high voltage required in this image forming system, there are, for example, a charge high voltage, a development high voltage, a first transfer high voltage, a second transfer high voltage, a cleaning high voltage, and a fusing high voltage. In order to maintain an optimal color image, a color image density sensor formed with a light emitting device and a light receiving device around a transfer belt is disposed, and according to the output of the color image density sensor, the level of a high voltage output such as the charge high voltage, the first transfer high voltage, and the second transfer high voltage, etc., is controlled. However, generally, in order to sense an image density in the color image density sensor, for example, a 5V power source voltage is used, and in order to analog-to-digitally convert the output of the color image density sensor, for example, a 3.3V power source voltage is used. Also, in order to recognize the environment of an image forming system, a detection value for environment recognition is measured at a predetermined cycle after the image forming system begins operation. The detection value for environment recognition can be, for example, the roll resistance value of a charge roller, a first transfer roller, and a second transfer roller. The roll resistance value changes by factors such as aging of the system and internal temperature rising, and accordingly, the charge high voltage and the first and second transfer high voltages need to be adjusted. However, generally, in order to measure the roll resistance value, for example, a 5V power source voltage is used, and in order to analog-to-digitally convert the measured roll resistance value, for example, a 3.3V power source voltage is used.

Thus, when a color image density is sensed or an environment detection value is measured, by using a second power source voltage that is different from a first power source voltage used in analog-to-digital conversion, if the second power source voltage changes due to a change in the power line or a system variation, it becomes impossible to obtain an accurate color image density or environment detection value, and as a result, it becomes very difficult to precisely control a high voltage output and an image density.

SUMMARY OF THE INVENTION

The present general inventive concept provides a method and apparatus by which when a predetermined analog value is measured to control an image density or a high voltage output, a power source voltage variation due to a change in a power line or a system variation is corrected such that the image density or the high voltage output can be controlled more precisely, and an image forming system employing the method and apparatus.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a method of correcting a power source voltage variation in an image forming system, the method including: when a first power source voltage to measure a predetermined analog value is different from a second power source voltage to provide analog-to-digital conversion of the analog value, determining a correction amount with respect to a variation between the first power source voltage and a rated power source voltage; calculating the variation between the first power source voltage and the rated power source voltage; and performing digital conversion by applying the correction amount based on the calculated variation, to a measured analog value.

The foregoing and/or other aspects and advantages of the present general inventive concept are also achieved by providing an apparatus that corrects a power source voltage variation in an image forming system, including: an image density sensing unit which senses an image density; a first variation correction unit which calculates a variation between a first power source voltage of the image density sensing unit and a first reference value, and performs correction by applying a correction amount, based on the calculated variation, to an image density sensed in the image density sensing unit; an environment detection value measuring unit which measures a roll resistance value for environment recognition; and a second variation correction unit which calculates a variation between a second power source voltage of the environment detection value measuring unit and a second reference value, and performs correction by applying a correction amount, based on the calculated variation, to a roll resistance value measured in the environment detection value measuring unit.

The foregoing and/or other aspects and advantages of the present general inventive concept are also achieved by providing an image forming system including: an image processing unit which converts print data, received from a computer requesting printing, into image data to drive an engine; an engine control unit which receives the image data provided by the image processing unit and is in charge of overall engine control by using a predetermined control program; an engine unit which forms an image on a paper from the image data provided by the engine control unit; an image density sensing unit which senses an image density in the engine unit; and a first variation correction unit which calculates a variation between a first power source voltage of the image density sensing unit and a first reference value, performs a correction of the image density by applying a correction amount, with respect to the calculated variation, to an image density sensed in the image density sensing unit, performs analog-to-digital conversion of the corrected image density, and provides the converted image density to the engine control unit.

In an aspect of the present general inventive concept, the image forming system may further include an environment detection value measuring unit which measures a roll resistance value for environment detection in the engine unit; and a second variation correction unit which calculates a variation between a second power source voltage of the environment detection value measuring unit and a second reference value, performs correction by applying a correction amount, with respect to the calculated variation, to a roll resistance value measured in the environment detection value measuring unit, performs analog-to-digital conversion of the corrected roll resistance value, and provides the converted roll resistance value to the engine control unit.

In an aspect of the present general inventive concept, the method of correcting a power source voltage variation can be implemented by a computer readable recording medium having embodied thereon a computer program for the method.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE PREFERRED EMBODIMENTS

Figure 1:
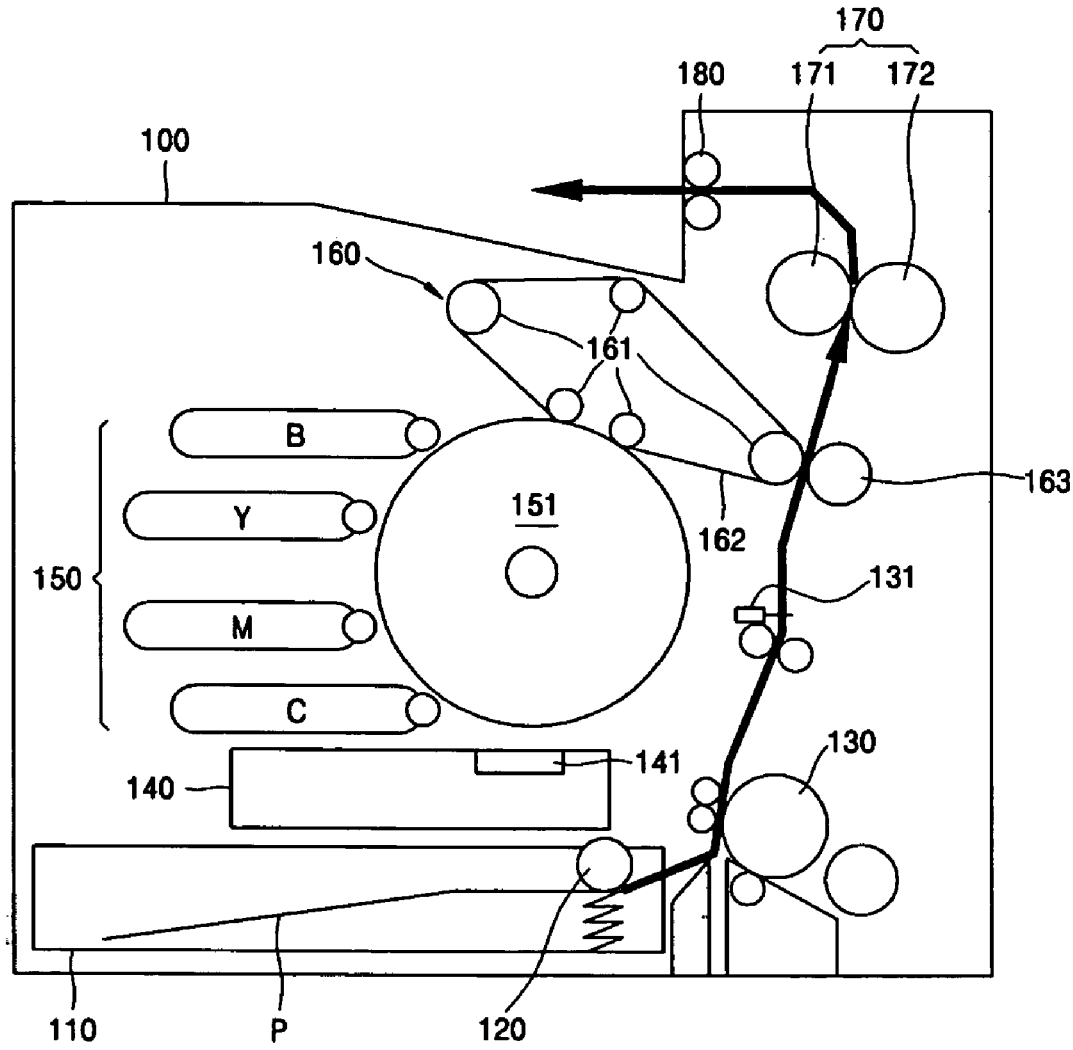
FIG. 1 is a side cross sectional view illustrating the mechanism of an image forming system to which a method of correcting a power source voltage variation according to the present general inventive concept is applied.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Referring to FIG. 1, an image forming system, to which a method of correcting a voltage variation according to an embodiment of the present general inventive concept is applied, includes a loader unit 110, a pickup unit 120, a paper feeder unit 130, an exposure unit 140, a developing unit 150, a transfer unit 160, a fusing unit 170, and a paper return unit 180.

Referring to FIG. 1, the loader unit 110 can be formed as a cassette, and detachably disposed below the main body 100, and accommodates paper (P) or any other type of image recording medium. A paper (P) is picked up by the pickup unit 120, which is rotatably disposed on the main body 100, and transferred inside the main body 100 along a direction indicated by the dark arrow illustrated in FIG. 1.

The pickup unit 120 can be formed with a pickup roller, and draws a paper (P) from the loader unit 110. The paper feeder unit 130 can be formed with a paper feeder roller and transfers a paper (P) drawn from the loader unit 110 to the inside of the main body 100. A paper feeder sensor 131 detects a front edge of the paper (P), and depending on whether or not the front edge of the paper (P) is detected, senses whether the pickup of the paper (P) from the loader unit 110 by the pickup unit 120 is successfully performed.

The exposure unit 140 scans light, corresponding to an image signal onto a photosensitive drum charged to have an even potential to form an electrostatic latent image. The exposure unit 140 is generally formed with a laser scanning unit (LSU) using a laser diode as a light source, and at this time, a light window 141, through which a laser beam irradiated by the laser diode is irradiated to the outside of the exposure unit 140, is disposed such that the light window 141 faces the photosensitive drum 151.

The developing unit 150 can be formed with a plurality of ink cartridges disposed to contact the photosensitive drum 151 in order to develop an electrostatic latent image, which is formed on the surface of the photosensitive drum 151 by the exposure unit 140 according to an image signal, into a predetermined color image. Developing material stored in the plurality of ink cartridges is overlapped onto the electrostatic latent image formed on the photosensitive drum 151 to form a predetermined visible image.

The transfer unit 160 is formed with a transfer belt 162 and a transfer roller 163. While rotating in a closed loop, supported by a plurality of transfer belt backup rollers 161, the transfer belt receives a toner image formed on the surface of the photosensitive drum 151. The transfer roller 163 is disposed to face any one of the plurality of backup rollers 161 with the transfer belt 162 placed between the transfer roller 163 and the backup roller 161, and puts pressure on the paper (P) in the transfer belt 162 direction. Accordingly, the color toner image transferred to the transfer belt 162 from the photosensitive drum 151 is again transferred to the paper (P). At this time, it is desirable that the rotational linear velocity of the transfer belt 162 is identical to the rotational linear velocity of the photosensitive drum 151. Also, the length of the transfer belt 162 should be equal to or longer than the length of the paper (P) to which the color toner image is finally received.

In the transfer unit 160, the transfer roller 163 is disposed to face the transfer belt 162. The transfer roller 163 is separated from the transfer belt 162 while a color toner image is being transferred to the transfer belt 162, and when the color toner image is completely transferred to the transfer belt 162, in order to transfer the image to the paper (P), the transfer roller 163 contacts the transfer belt 162 at a predetermined pressure.

The fusing unit 170 can be formed with a fusing roller 171 which generates heat, and a pressure roller 172. The pressure roller 172 is disposed to face the fusing roller 171 with the paper (P) being transferred to be placed between the pressure roller 172 and the fusing roller 171, and puts pressure on the paper (P) in the fusing roller 171 direction. The fusing roller 171 applies heat to the paper (P) on which a visible image is formed, to fuse the visible image to the paper (P). The paper return unit 180 can be formed with a paper return roller, and returns the paper (P) on which a visible image is formed, to the outside. For printing both sides of a paper, the paper return roller can be reversely rotated such that the paper (P) is reversed and transferred along the reversed path.

Figure 2:
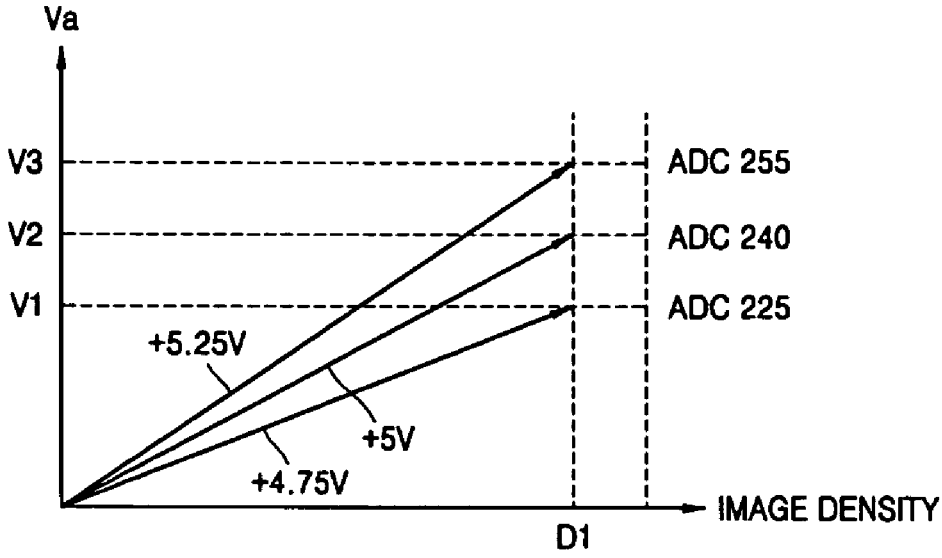
FIG. 2 is a graph comparing outputs of an image density sensor with respect to a power source voltage relative to an identical image density.

FIG. 2 is a graph comparing outputs of an image density sensor with respect to a power source voltage relative to an identical image density. Here, it is assumed that a rated power source voltage of an image density sensor is 5V and a rated power source voltage of an analog-to-digital converter is 3.3V.

Referring to FIG. 2, when the image density sensor senses an identical image density (D1), if the power source voltage is +4.75V, the output voltage Va from the image density sensor is V1, if the power source voltage is +5V, then the output voltage Va from the image density sensor is V2, and if the power source voltage is +5.25V, then the output voltage Va from the image density sensor is V3. The voltage values, V1, V2, and V3 output from the image density sensor are 8-bit analog-to-digital converted to have digital values of, for example, 225, 240, and 255, respectively. Thus, when the power source voltages are different, the image density sensor outputs different voltage values even at an identical image density (D1), and the variation width of the output values of the image density sensor relative to different power source voltages increases as the sensed image density becomes higher. The graph shown in FIG. 2 may also be applied to a case where the image density is replaced with a roll resistance value.

Figure 3:
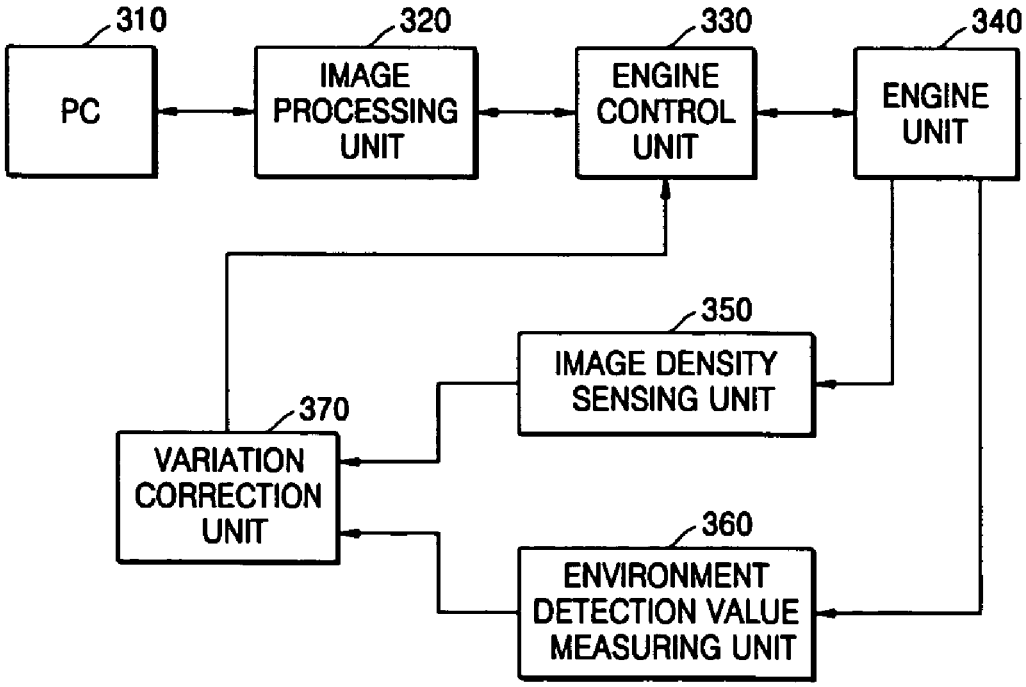
FIG. 3 is a block diagram of the structure of an image forming system including an apparatus that corrects a power source voltage variation, according to an embodiment of the present general inventive concept.

FIG. 3 is a block diagram of the structure of an image forming system including an apparatus that corrects a voltage variation, according to another embodiment of the present general inventive concept. The image forming system includes a PC 310, an image processing unit 320, an engine control unit 330, an engine unit 340, an image density sensing unit 350, an environment detection value measuring unit 360, and a variation correction unit 370.

Referring to FIG. 3, the image processing unit 320 converts print data received from an external apparatus, for example, the PC 310, connected to a communication interface, into image data appropriate to operate the engine unit 340 according to printing conditions set in a printer driver (not shown), and stores the image data in a storage medium (not shown) internal or external to the system. The storage medium temporarily stores a variety of control programs required to implement the function of the image forming system, various data being generated with performing the control programs, and print data and printing information received from the PC 310.

The engine control unit 330 controls the engine unit 340 such that an image corresponding to the image data received from the image processing unit 320 can be printed on a paper or another image recording medium. For this, if a print command from the image processing unit 320 is received, the engine control unit 330 prepares the units 120 through 180 (FIG. 1) forming the engine unit 340 to be ready for printing. Examples of printing preparation include rotating a polygonal rotating mirror or a scan disk that is a deflection means used in the exposure unit 140, at a preset rotation speed, heating the fusing unit 170 to a preset temperature, and checking whether or not each unit 120 through 180 has a problem in performing the printing job. Accordingly, after the printing command from the image processing unit 320 is received by the engine control unit 330, if it is determined after a printing preparation time that printing is ready to be performed, the engine control unit 330 provides a print start signal to the image processing unit 320 such that image data stored in the storage medium is provided to the exposure unit 140 through the engine control unit 330.

The engine unit 340 is formed with a variety of units required to provide printing, for example, the pickup unit 120, the paper feeder unit 130, the exposure unit 140, the developing unit 150, the transfer unit 160, the fusing unit 170, and the paper return unit 180, in case the electrophotographic method is used. Thus, the engine unit 340 can be a variety of structures according to the printing methods.

The image density sensing unit 350 can include a color image density sensor formed with a light emitting device and a light receiving device disposed around the transfer belt, and provides an output voltage corresponding to the image density sensed by the color image density sensor to the variation correction unit 370. The sensed image density is used to control the level of a high voltage output such as a charge high voltage, a first transfer high voltage, or a second transfer high voltage. The image density sensing unit 350 measures a first power source voltage used to drive the image density sensing unit 350 and provides the first power source voltage to the variation correction unit 370. The first power source voltage may be measured using at least one resister acting as a voltage divider and adjusted according to a dividing ratio.

The environment detection value measuring unit 360 measures a voltage corresponding to a roll resistance value for environment detection, that is, an environment detection value, and provides the measured environment detection value to the variation correction unit 370. The environment detection value is the roll resistance value of, for example, a charge roller, a first transfer roller, or a second transfer roller. The environment detection value measuring unit 360 measures a second power source voltage used to drive the environment detection value measuring unit 360 and provides the second power source voltage to the variation correction unit 370. Similarly, the second power source voltage may be measured using at least one resister acting as a voltage divider and adjusted according to a dividing ratio.

The variation correction unit 370 calculates a first variation between the first power source voltage provided from the image density sensing unit 350 and a first reference value, and determines a first correction amount with respect to the first variation. The first reference value refers to a first rated power source voltage specified to be used in the image density sensing unit 350. The output voltage corresponding to the image density from the image density sensing unit 350 is corrected based on the first correction amount and the corrected output voltage, that is, the corrected image density is analog-to-digital converted to then be provided to the engine control unit 340. Also, the variation correction unit 370 calculates a second variation between the second power source voltage provided from the environment detection value measuring unit 360 with a second reference value, and determines a second correction amount with respect to the second variation. The second reference value refers to a second rated power source voltage specified to be used in the environment detection value measuring unit 360. The output voltage corresponding to the environment detection value from the environment detection value measuring unit 360 is corrected based on the second correction amount and the corrected output voltage, that is, the corrected environment detection value is analog-to-digital converted to then be provided to the engine control unit 340.

Figure 4:
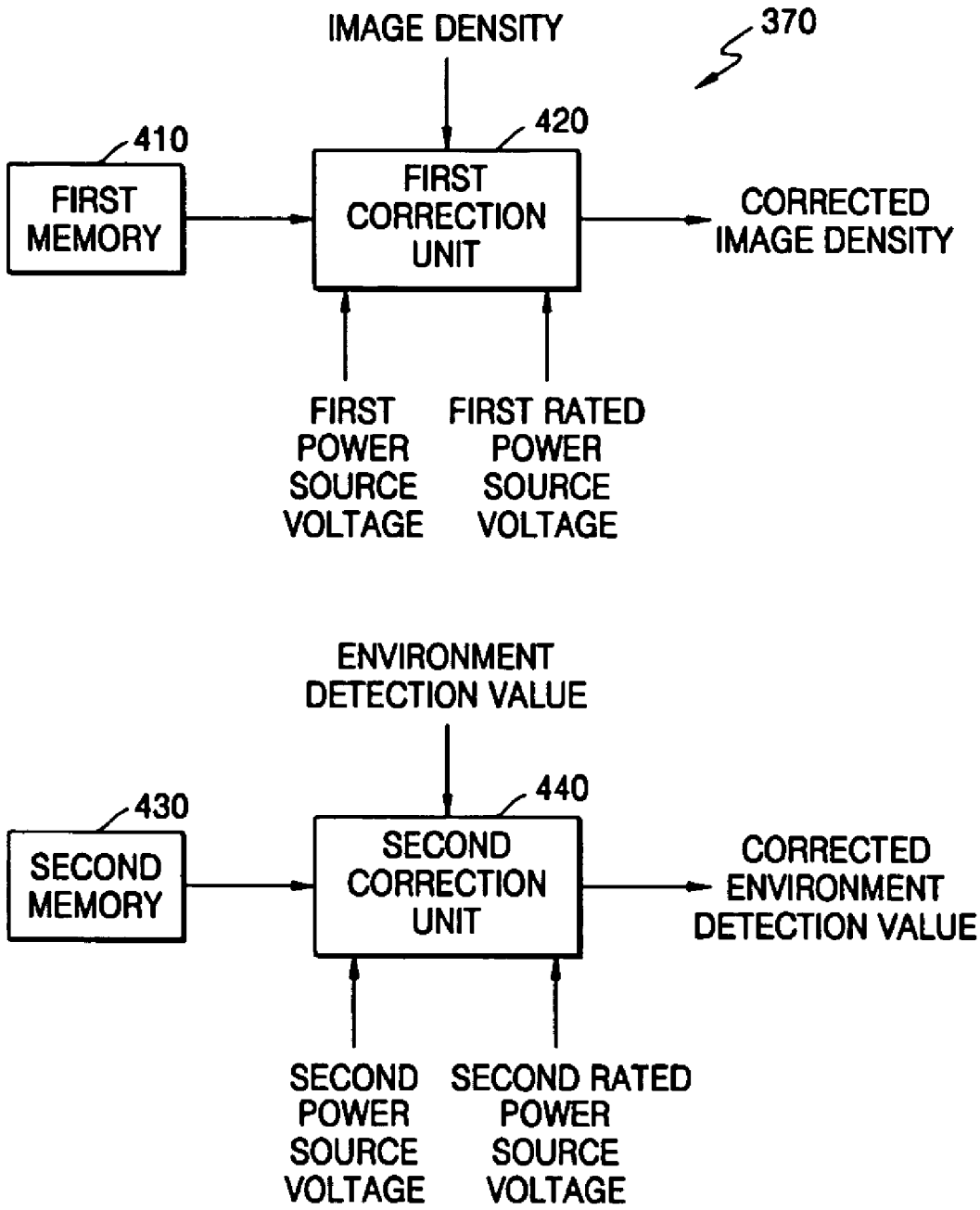
FIG. 4 is a detailed block diagram of a variation correction unit in FIG. 3.

FIG. 4 is a detailed block diagram of the variation correction unit 370 in FIG. 3, which includes a first memory 410, a first correction unit 420, a second memory 430, and a second correction unit 440.

Referring to FIG. 4, when a first power source voltage used in the image density sensing unit 350 is different from a third power source voltage used to analog-to-digitally convert the output voltage from the image density sensing unit 350, the first memory 410 can obtain by experiment a correction amount with respect to the variation between the first power source voltage and the first reference value and the output voltage from the image density sensing unit 350 in advance, and can store them in the form of, for example, a lookup table.

The first correction unit 420 calculates a variation between the first power source voltage provided from the image density sensing unit 350 and the first reference value, and reads the correction amount corresponding to the calculated variation from the first memory 410. The correction amount corresponding to the calculated variation from the first memory 410 is applied to the output voltage from the image density sensing unit 350 to then generate the corrected output voltage.

When a second power source voltage used in the environment detection value measuring unit 360 is different from a third power source voltage used to analog-to-digitally convert the output voltage from the environment detection value measuring unit 360, the second memory 430 can obtain by experiment a correction amount with respect to the variation between the second power source voltage and the second reference value and the output voltage from the environment detection value measuring unit 360 in advance, and can store them in the form of, for example, a lookup table.

The second correction unit 440 can calculate a variation by comparing the second power source voltage provided from the environment detection value measuring unit 360 with the second reference value, and can read a correction amount corresponding to the calculated variation from the second memory 430. The correction amount corresponding to the calculated variation from the second memory 430 is applied to the output voltage from the environment detection value measuring unit 360 to then generate the corrected output voltage.

Figure 5:
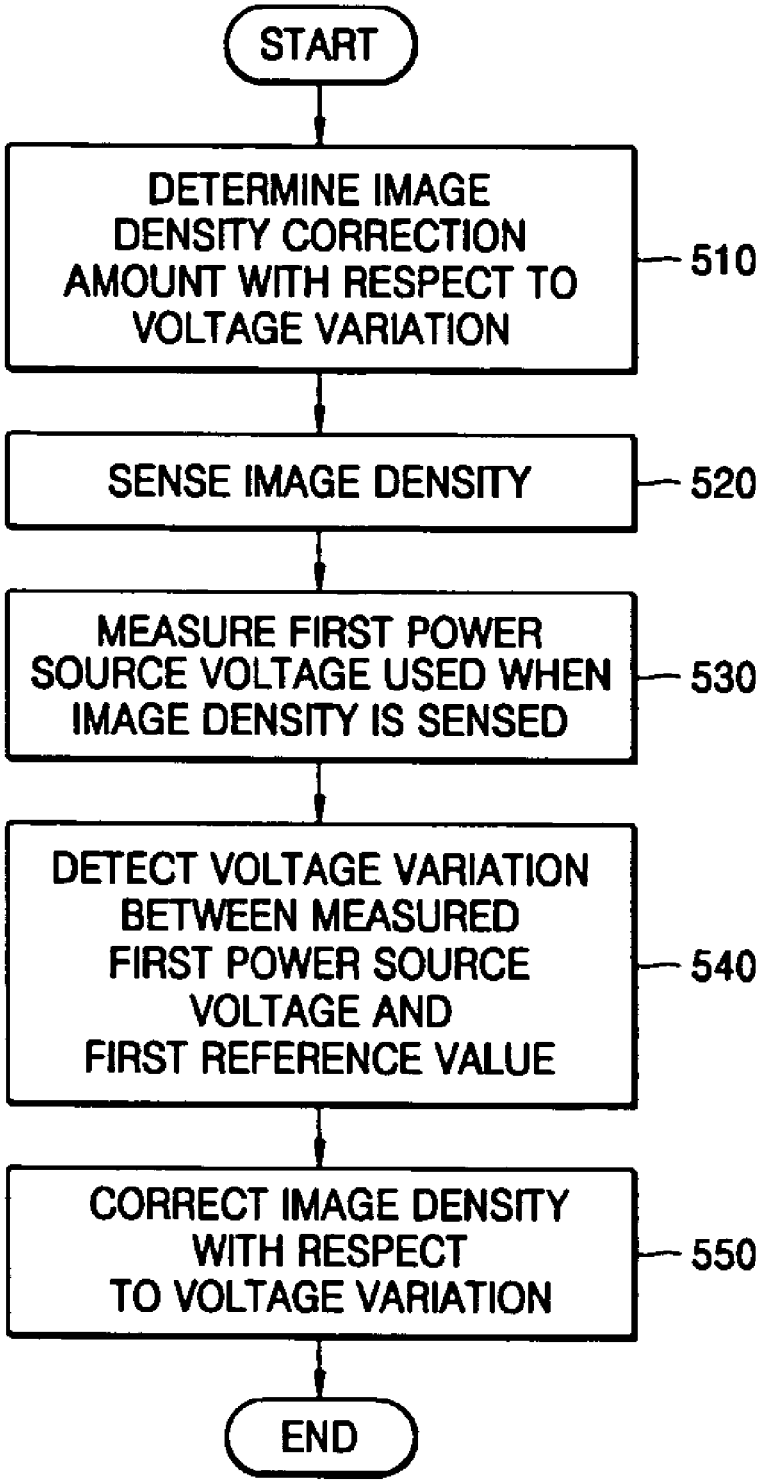
FIG. 5 is a flowchart of operations performed by a method of correcting a power source voltage variation, according to an embodiment of the present general inventive concept.

FIG. 5 is a flowchart illustrating operations performed by a method of correcting a power source voltage variation, according to another embodiment of the present general inventive concept.

Referring to FIG. 5, in operation 510, when a first power source voltage used to sense an image density is different from a third power source voltage used to analog-to-digitally convert a sensed image density, a correction amount with respect to the variation between the first power source voltage and the first reference value is obtained by experiment and stored in advance in the first memory 410, for example, in the form of a lookup table.

In operation 520, the image density sensing unit 350 senses an image density. In operation 530, a first power source voltage provided when an image density is sensed is measured. In operation 540, a variation is calculated by comparing the measured first power source voltage with a first reference value in the first correction unit 420. In operation 550, a correction amount corresponding to the calculated variation from the first memory 410 is read, applied to the measured image density, and the corrected image density is provided.

Figure 6:
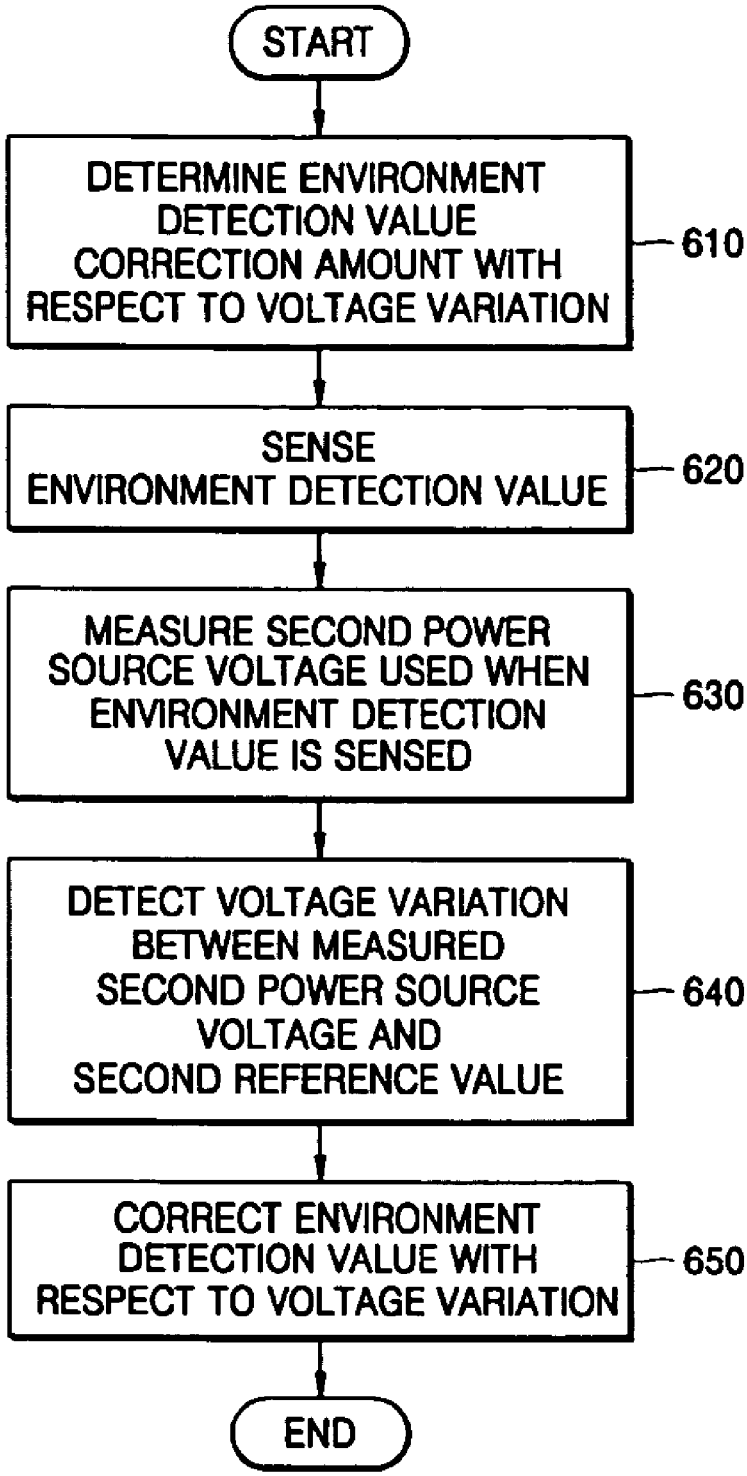
FIG. 6 is a flowchart of operations performed by a method of correcting a power source voltage variation, according to another embodiment of the present general inventive concept.

FIG. 6 is a flowchart of operations performed by a method of correction a power source voltage variation, according to another embodiment of the present general inventive concept.

Referring to FIG. 6, in operation 610, when a second power source voltage used to measure a roll resistance value is different from a third power source voltage used to digitally convert a measured roll resistance value, a correction amount with respect to the variation between the second power source voltage and a second reference value is obtained by experiment and stored in the second memory 430 in advance, for example, in the form of a lookup table.

In operation 620, a roll resistance value for environment detection, that is, an environment detection value is measured in the environment detection value measuring unit 360. In operation 630, a second supply source voltage provided when the roll resistance value is measured. In operation 640, a variation is calculated by comparing the measured second power source voltage with a second reference value in the second correction unit 440. In operation 650, a correction amount corresponding to the calculated variation is read from the second memory 430, applied to the measured environment detection value, and the corrected environment detection value is provided.

The present general inventive concept can also be embodied as computer readable codes on a computer readable recording medium. The computer readable recording medium can be any data storage device that can store data which can thereafter be read by a computer system. Examples of the computer readable recording medium include a read-only memory (ROM), a random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing the present general inventive concept can be easily construed by programmers skilled in the art to which the present general inventive concept pertains.

According to the present general inventive concept as described above, when a first power source voltage used to measure a predetermined analog value for controlling an image density or a high voltage output is different from a second power source voltage used to analog-to-digitally convert the analog value, the voltage variation due to change in a power line or system variation is corrected such that an image density or a high voltage output can be controlled more precisely.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims. The preferred embodiments should be considered in descriptive sense only and not for purposes of limitation. Therefore, the scope of the general inventive concept is defined not by the detailed description of the general inventive concept but by the appended claims, and all differences within the scope will be construed as being included in the present general inventive concept.

What is claimed is:

1. A method of correcting a power source voltage variation in an image forming system, comprising:

calculating a variation between a first power source voltage used to measure a predetermined analog value and a rated power source voltage;

determining a correction amount with respect to the variation between the first power source voltage and the rated power source voltage when the first power source voltage is different from a second power source voltage for analog-to-digital conversion of the analog value; and performing digital conversion by applying the correction amount based on the calculated variation to a measured analog value.

2. The method of claim 1, wherein the analog value is an image density output from an image density sensor.

3. The method of claim 1, wherein the analog value is a roll resistance value for environment recognition.

4. A computer readable recording medium having embodied thereon a computer program containing a method of correcting a power source voltage variation in an image forming system, comprising:

calculating a variation between a first power source voltage used to measure a predetermined analog value and a rated power source voltage;

determining a correction amount with respect to a variation between the first power source voltage and the rated power source voltage when the first power source voltage is different from a second power source voltage for analog-to-digital conversion of the analog value; and performing digital conversion by applying the correction amount based on the calculated variation to a measured analog value.

5. An apparatus to correct a power source voltage variation in an image forming system, comprising:

an image density sensing unit which senses an image density;

a first variation correction unit which calculates a variation between a first power source voltage of the image density sensing unit and a first reference value, and performs a correction by applying a correction amount based on the calculated variation to an image density sensed in the image density sensing unit;

an environment detection value measuring unit which measures a roll resistance value for environment recognition; and a second variation correction unit which calculates a variation between a second power source voltage of the environment detection value measuring unit and a second reference value, and performs correction by applying a correction amount based on the calculated variation to a roll resistance value measured in the environment detection value measuring unit.

6. The apparatus of claim 5, wherein the first variation correction unit comprises:

a memory which when the first power source voltage is different from a third power source voltage for digital conversion of the image density, stores a correction amount with respect to the variation between the first power source voltage and the first reference value; and a correction unit which calculates a variation between the first power source voltage and the first reference value, reads a correction amount corresponding to the calculated variation from the memory, applies the correction amount to the measured image density, and provides the corrected image density.

7. The apparatus of claim 5, wherein the second variation correction unit comprises:

a memory which when the second power source voltage is different from a third supply power source voltage for digital conversion of the image density, stores a correction amount with respect to the variation between the second power source voltage and the second reference value; and a correction unit which calculates a variation between the second power source voltage and the second reference value, reads a correction amount corresponding to the calculated variation from the memory, applies the correction amount to the measured roll resistance value, and provides the corrected roll resistance value.

8. An image forming system comprises:

an image processing unit which converts print data received from a computer requesting printing into image data to drive an engine;

an engine control unit which receives image data provided by the image processing unit and is in charge of overall engine control by using a predetermined control program;

an engine unit which forms an image on a paper from the image data provided by the engine control unit;

an image density sensing unit which senses an image density in the engine unit; and a first variation correction unit which calculates a variation between a first power source voltage of the image density sensing unit and a first reference value, performs a correction of image density by applying a correction amount with respect to the calculated variation to an image density sensed in the image density sensing unit, performs analog-to-digital conversion of the corrected image density, and provides the converted image density to the engine control unit.

9. The image forming system of claim 8, further comprising:

an environment detection value measuring unit which measures a roll resistance value for environment detection in the engine unit; and a second variation correction unit which calculates a variation between a second power source voltage of the environment detection value measuring unit and a second reference value, performs a correction by applying a correction amount with respect to the calculated variation to a roll resistance value measured in the environment detection value measuring unit, performs analog-to-digital conversion of the corrected roll resistance value, and provides the converted roll resistance value to the engine control unit.

10. The image forming system of claim 8, wherein the first variation correction unit comprises:

a memory which stores a correction amount with respect to the variation between the first power source voltage and the first reference value when the first power source voltage is different from a third power source voltage for digital conversion of the image density; and a correction unit which calculates a variation between the first supply power source voltage and the first reference value, reads a correction amount corresponding to the calculated variation from the memory, applies the correction amount to the measured image density, and provides the corrected image density.

11. The image forming system of claim 9, wherein the second variation correction unit comprises:

a memory which stores a correction amount with respect to the variation between the second power source voltage and the second reference value when the second power source voltage is different from a third power source voltage for digital conversion of the image density,; and a correction unit which calculates a variation between the second power source voltage and the second reference value, reads a correction amount corresponding to the calculated variation from the second memory, applies the correction amount to the measured roll resistance value, and provides the corrected roll resistance value.

12. The image forming system of claim 9, wherein the environment detection value is a roll resistance value of a charge roller, a first transfer roller, or a second transfer roller.

13. An apparatus to correct a voltage variation in an image forming system, comprising:

an image density sensing unit which senses an image density;

an environment detection value measuring unit which measures a roll resistance value for environment recognition; and a variation correction unit which calculates a variation between a first power source voltage of the image density sensing unit and a first reference value, performs a first correction of the first power source voltage by applying a correction amount based on the calculated variation to an image density sensed in the image density sensing unit, calculates a variation between a second power source voltage of the environment detection value measuring unit and a second reference value, and performs a second correction of the second power source voltage by applying a correction amount based on the calculated variation to a roll resistance value measured in the environment detection value measuring unit.

14. The apparatus of claim 13, further comprising:

a first memory which stores a correction amount with respect to the variation between the first power source voltage and the first reference value when the first power source voltage is different from a third power source voltage for digital conversion of the image density;

a first correction unit which calculates a variation between the first power source voltage and the first reference value, reads a correction amount corresponding to the calculated variation from the first memory, applies the correction amount to the measured image density, and provides the corrected image density;

a second memory which stores a correction amount with respect to the variation between the second power source voltage and the second reference value when the second power source voltage is different from a third supply power source voltage for digital conversion of the image density; and a second correction unit which calculates a variation between the second power source voltage and the second reference value, reads a correction amount corresponding to the calculated variation from the second memory, applies the correction amount to the measured roll resistance value, and provides the corrected roll resistance value.

15. An image forming system that converts received print data into image data and forms an image corresponding to the image data, comprising:

an image density sensing unit which senses an image density of the formed image; and a first variation correction unit which calculates a variation between a first power source voltage of the image density sensing unit and a first reference value, performs a correction of image density by applying a correction amount with respect to the calculated variation to an image density sensed in the image density sensing unit, performs analog-to-digital conversion of the corrected image density, and provides the converted image density to the engine control unit.

16. The image forming system of claim 15, further comprising:

an environment detection value measuring unit which measures a roll resistance value for environment detection in the engine unit; and a second variation correction unit which calculates a variation between a second power source voltage of the environment detection value measuring unit and a second reference value, performs a correction by applying a correction amount with respect to the calculated variation to a roll resistance value measured in the environment detection value measuring unit, performs analog-to-digital conversion of the corrected roll resistance value, and provides the converted roll resistance value to a controller that controls the density of the image to be printed.

* * * * *